United States Patent [19]

Berlin et al.

[11] Patent Number: 4,774,878

[45] Date of Patent: Oct. 4, 1988

[54] TRIMODAL PISTON DRIVEN SASH OPERATOR

[75] Inventors: Robert M. Berlin, Linwood; Richard L. Wendt; Warren L. Ziegler, both of Midland, all of Mich.

[73] Assignee: Tri City Laboratory Specialists, Inc., Midland, Mich.

[21] Appl. No.: 929,058

[22] Filed: Nov. 12, 1986

[51] Int. Cl.[4] ..... F23J 11/00

[52] U.S. Cl. ..... 98/115.3; 49/200

[58] Field of Search ..... 98/115.3; 49/445, 447, 49/200; 16/193, 194

[56] References Cited

U.S. PATENT DOCUMENTS

| | | | |
|---|---|---|---|
| 3,820,446 | 6/1974 | Granbom et al. | 92/138 |
| 3,934,496 | 1/1976 | Turko | 49/445 |
| 4,150,606 | 4/1979 | Nelson | 98/115.3 |
| 4,363,267 | 12/1982 | Greer | 49/445 |
| 4,377,969 | 3/1983 | Nelson | 98/115.3 |
| 4,502,375 | 3/1985 | Hignite et al. | 49/200 |
| 4,548,128 | 10/1985 | Morikawa | 98/115.3 |

FOREIGN PATENT DOCUMENTS 326376 7/1970 Sweden .

*Primary Examiner*—Larry I. Schwartz

*Attorney, Agent, or Firm*—Robert L. McKellar

[57] ABSTRACT

What is disclosed is a new and novel fume hood sash operator system and a fume hood containing such a system. The sash operator is constructed to operate from a pressure fluid cylinder so that the sash member can be stopped, started, moved up or down to accommodate changes in the flow of air moving through the hood structure and to provide a safe, durable, energy savings sash operating system.

6 Claims, 4 Drawing Sheets

TRIMODAL PISTON DRIVEN SASH OPERATOR

BACKGROUND OF INVENTION

The instant invention deals with a trimodal piston driven sash operator for fume hoods and fume hoods so equipped. Fume hoods are a common item of most every chemical laboratory and have been employed in one form or another for many years. As new materials and techniques are evolved, the fume hood undergoes modifications to attempt to ensure the working personnel freedom from spills and burns, noxious gases and chemicals. In recent years, this concern for safety has been coupled with a concern for energy conservation and certain modifications were made in standard fume hoods to ensure some energy savings while retaining the safety aspects of such hoods. For example, the air intake and exhaust ducts were adapted to electrical or penumatic dampers or adjustable speed motors which would work to adjust motor speeds or duct openings in order to utilize only the mass of air that was required for safety purposes while not allowing large volumes of air to continuously pass through the fume hood and cause a waste of energy.

Another recent development in energy conservation was the use of an automatic fume hood sash operator which was electrically coupled with an automatic switch mechanism, such as a rubber floor switch mat, or a photo electric eye such as disclosed in U.S. Pat. No. 4,150,606 issued Apr. 24, 1979 to Laurence N. Nelson,. The gist of that invention appears to be a sash operator which is actuated by a continuous cable loop carrying an activator switch which contacts limit switches which are built into the line of travel of the activator switch. A movable sash member of the hood structure is raised or lowered in correspondence to the movement of the activator switch. No provision is made in the Nelson invention for control of the sash member in a stop position if the sash member encounters an obstruction. Furthermore, the Nelson sash closer cannot be used in a fume hood where the counter-balancing weight for the sash member is required to be in the back of the unit. Finally, it is obvious that the Nelson invention would not be readily adaptable to existing fume hood structures since the design of the closure mechanism requires the counter-balancing weights to be positioned in the path of the control units for the hood, thus requiring extensive modification of hoods that are in place and functioning today.

BRIEF SUMMARY OF THE INVENTION

The instant invention is directed to a new and novel means of driving a sash member in an access opening. The fume hood may be moved into a closed or partially closed position and opened or partially opened position. In addition, the instant invention deals in part with a means of protecting operating personnel since a means for interrupting the movement of the sash member in the access opening at any point in the cycle of opening and closing of the sash, is provided.

Further, the instant invention deals with a manual override switching system in which the flow of air via the blower motors, the duct dampers and the sash member can be manually controlled outside of the inner connected electrical system of the hood.

The instant invention also includes a fume hood into which the drive means is incorporated since the use of the inventive drive means in a fume hood allows for new and novel functions for such a fume hood, which heretofore were not available.

The inventive drive means is adaptable to almost any hood system of almost any design and even though it is primarily designed for newer, more modern designs of hoods, the instant invention can be readily adapted to existing hood structures.

Some of the newer hoods in use today have such features as occupying small spaces, controlled operation of exhaust blowers and auxiliary blowers and many other such functions and instant invention can and does allow, these functions to be incorporated in the design of the hoods owing to the very limited space that the drive means of the instant invention needs to occupy.

What is contemplated as one embodiment of the instant invention, is the use of a pressure fluid cylinder as a driving means for the freely movable sash wherein the pressure fluid cylinder is directly attached to the freely moving sash. Thus, what is disclosed herein is a trimodal piston driven sash operator for a fume hood structure, said fume hood structure having an access opening in one wall thereof and closure structure therefore, including a movable sash member disposed for movement in said access opening to vary the effective size of the opening thereof, comprising:

a power source;

a drive means driven by the power source; said drive means mounted on a stationary portion of the fume hood structure, which drive means is a pressure fluid cylinder having a slot extending longitudinally along its wall thereof, and a piston provided with a projection extending through said slot and slideable along said slot in concert with said piston when the driving means is activated from the power source;

a drive bracket being attached to said drive means by suitable means and said drive bracket detachedly fixed to the top of the moveable sash member;

a means of controlling the power source to control the movement of the drive means, to control the movement of the sash in said access opening. Another part of this embodiment is where the pressure fluid cylinder is directly attached to the freely moving weighted structures within the hood structure. Thus, what is further disclosed is a trimodal piston driven sash operator for a fume hood structure, said fume hood structure having an access opening in one wall thereof and a closure structure therefor, including a moveable sash member disposed for movement in said access opening thereof, comprising:

a power source:

a drive means powered by said power source; said drive means mounted on a stationary portion of the fume hood structure, which drive means is a pressure fluid cylinder having a slot extending longitudinally along its wall thereof, and a piston provided with a projection extending through said slot and slideable along said slot in concert with said piston when the drive means is activated from the power source;

a clamping means detachedly fixed to said projection;

a drive cable, said drive cable being detachedly fixed to the moveable sash member and extending from the moveable sash member to a freely rotatable first hood idler pulley which is vertically mounted on said fume hood structure; said drive cable continuing over the first hood idler pulley, extending to and around the outside of a freely rotatable, second hood idler pulley which is horizontally mounted on said fume hood structure; said drive cable passing to said drive means and being detachedly fixed thereto; said drive cable extending from said drive means to a freely rotatable, third hood idler pulley horizontally mounted on said hood structure, said drive cable passing around the outside of the third hood idler pulley and over a freely rotatable, vertically mounted fourth hood idler pulley mounted within the hood structure, the drive cable terminating and connecting to a freely moving weighted structure within the fume hood structure;

a means of controlling the drive means to control the movement of the drive cable to control the movement of said sash in said access opening.

Further, it is contemplated as a second embodiment of the instant invention to drive cables within the hood structure using the pressure fluid cylinder wherein the cables are attached to the sash member, which drive can or cannot be supplemented and enhanced by the use of dropping dead weights. Thus, what is further disclosed herein is a trimodal piston driven sash operator for a fume hood structure, said fume hood structure having an access opening in one wall thereof and a closure structure therefor, including a movable sash member disposed for movement in said access opening thereof, comprising:

a power source;

a drive means powered by said power source; said drive means mounted on a stationary portion of the fume hood structure, which drive means is a pressure fluid cylinder having a slot extending longitudinally along its wall thereof, and a piston provided with a projection extending through said slot and slideable along said slot in concert with said piston when the drive means is activated from the power source;

a clamping means detachedly fixed to said projection;

a drive cable, said drive cable being detachedly fixed to the moveable sash member and extending from the moveable sash member to a freely rotatable first hood idler pulley which is vertically mounted on said fume hood structure; said drive cable continuing over the first hood idler pulley, extending to and around the outside of a freely rotatable, second hood idler pulley which is horizontally mounted on said fume hood structure; said drive cable passing to said drive means and being detachedly fixed thereto; said drive cable extending from said drive means to a freely rotatable, third hood idler pulley horizontally mounted on said hood structure, said drive cable passing around the outside of the third hood idler pulley and over a freely rotatable, vertically mounted fourth hood idler pulley mounted within the hood structure, the drive cable terminating and connecting to a freely moving weighted structure within the fume hood structure;

a means of controlling the drive means to control the movement of the drive cable to control the movement of said sash in said access opening.

In the first embodiment, what is contemplated is the vertical attachment of the pressure fluid cylinder within the back or side of the fume hood structure, wherein, by the use of a suitable bracket, the pressure fluid cylinder is attached directly to a dropping dead weight and the dropping dead weight is attached by means of cables, and a pulley system, to the sash member. Thus, as the dropping dead weight is lowered or raised, the sash member responds in the opposite manner to raise or lower. Alternative to the attachment to the dropping dead weight, it is also contemplated that the pressure fluid cylinder can be vertically mounted on the top front of the fume hood structure and the pressure fluid cylinder drive means is fixed to the sash member directly by using a bracket arrangement. Thus, the sash member is directly driveny by the pressure fluid cylinder drive means. This can also be accomplished with or without the use of dropping dead weights. It is also contemplated within the scope of this invention to mount the pressure fluid cylinder on the top back of the fume hood structure and move the sash member directly by cables and pulleys, wherein the cables are attached directly to the drive means of the pressure fluid cylinder. This embodiment also contemplates carrying out this means with or without the use of dropping dead weights.

The second embodiment of this invention wherein the sash member is moved by the direct drive of cables attached to the sash member entails an attachment of a cable to the sash member, moving the cable over a series of pulleys to its attachment to the drive means of the pressure fluid cylinder, and the termination of the cable and connection to a dropping dead weight within the fume hood structure. Although the sash could be driven by such a means without dropping dead weights assisting, it is preferred that such dropping dead weights be used to enhance the smoothness of the movement of the sash. It is therefore also within the scope of this invention to use cables and pulleys and dropping dead weights to assist the movement of the sash member.

DETAILED DESCRIPTION OF THE DRAWINGS

Figure 1:
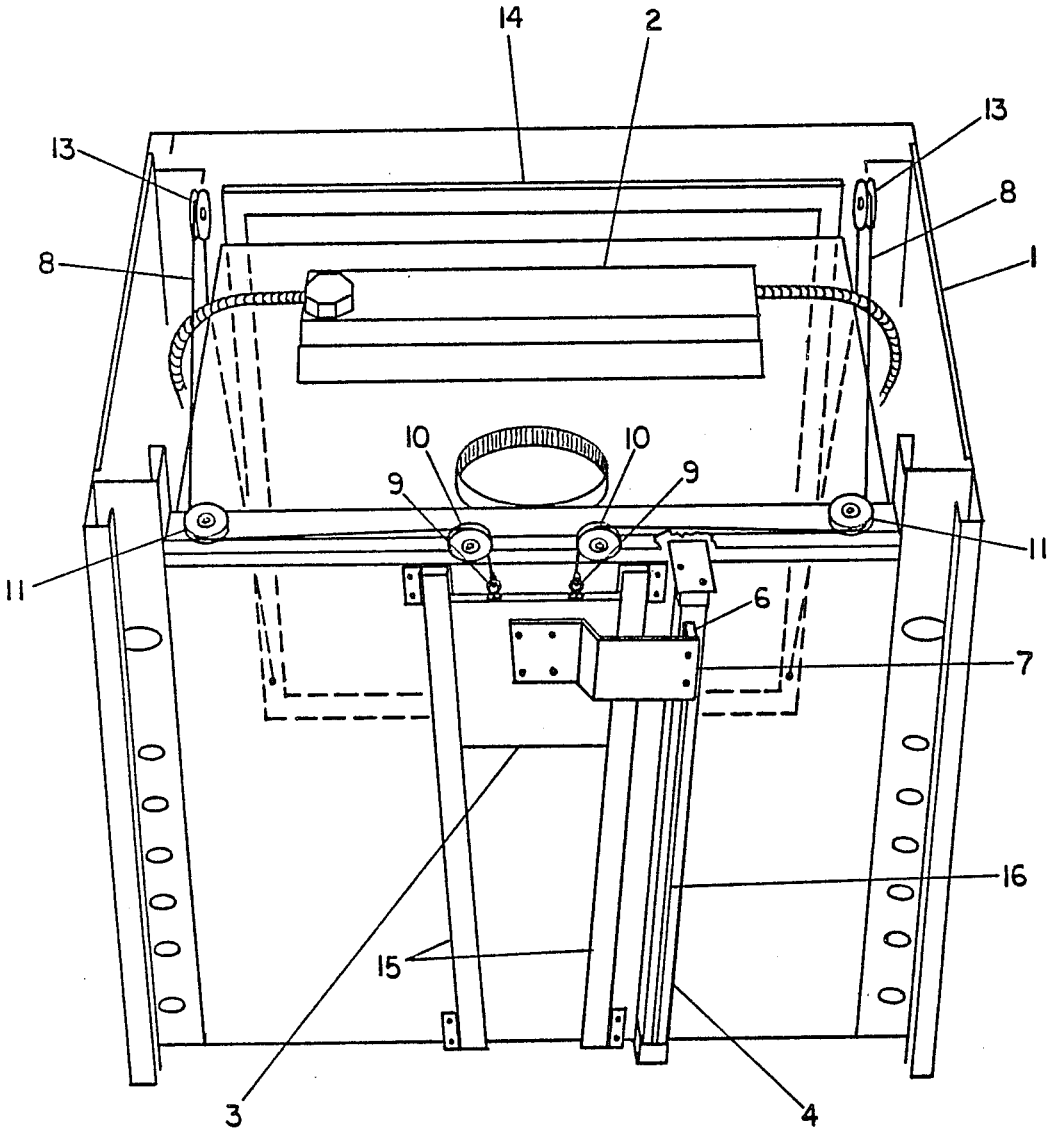
FIG. 1 is a perspective view of the top one half of a fume hood structure showing a conventional hood top with a lighting fixture in place and fume hood back with a centered dropping dead weight.
Figure 2:
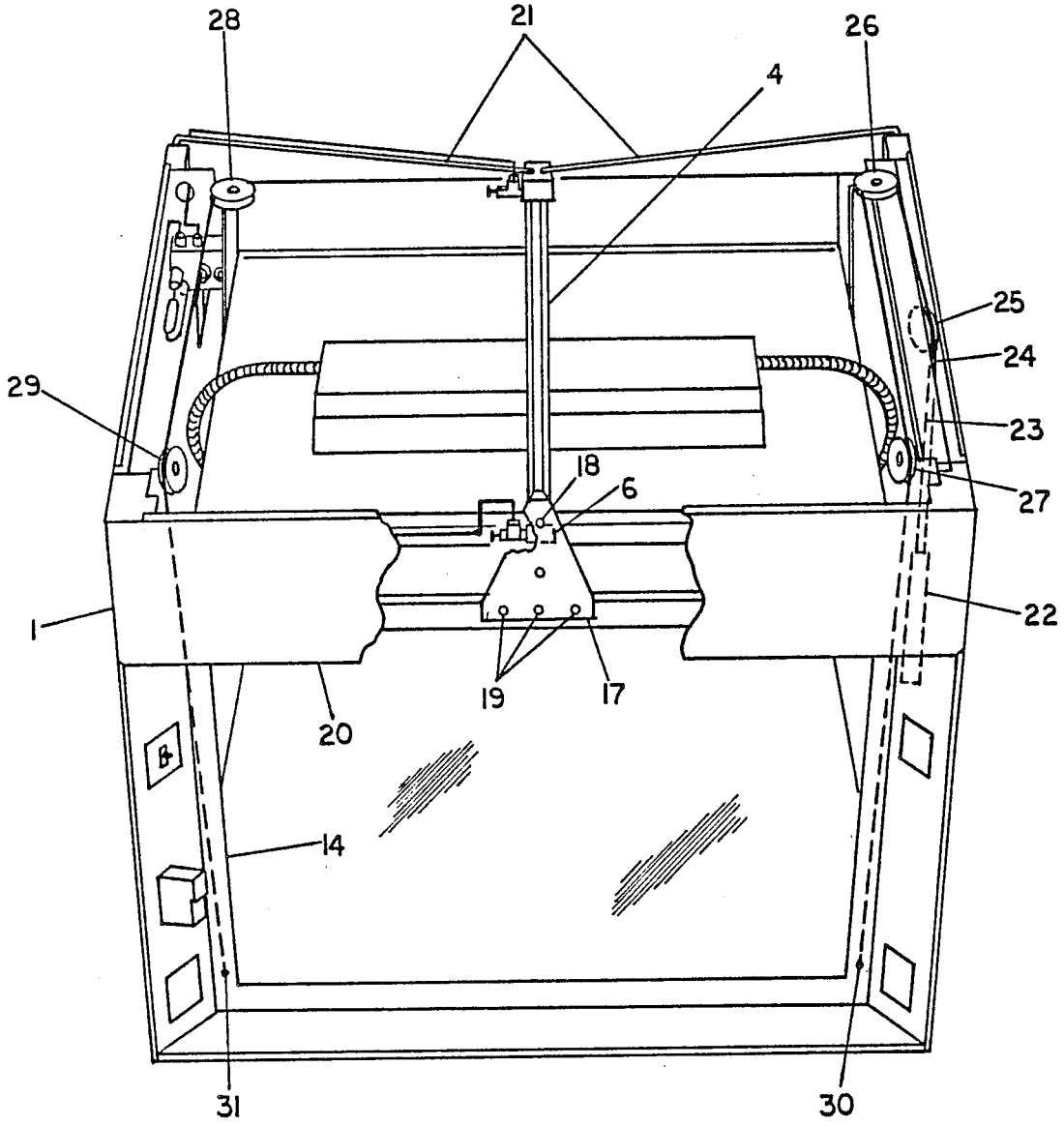
FIG. 2 is a perspective view of the top one half of a fume hood structure showing a conventional hood top and a fume hood front showing a moveable sash member in the down position and the attachment of the pressure fluid cylinder directly to said sash member.

Referring to the drawings and the specifically to FIG. 2, there is shown a perspective view 1 of the top one half of a conventional fume hood top arrangement with a lighting fixture 2 in place, and a fume hood back showing a centered dropping dead weight 3. Vertically attached to the fume hood structure 1 is a pressure fluid cylinder 4, The cylinder is shown on the right side of the dropping dead weight but it can be placed anywhere on the back as is convenient, and the cables and pulleys and brackets adjusted accordingly. Situated within the pressure fluid cylinder 4 is a drive means which consists of a piston (not shown) and a projection 6, connected to and driven by, and in concert with the piston along the slot 16. The pressure fluid cylinder is known in the art and details of its structure and general operation can be found in U.S. Pat. No. 3,820,446, issued June 28, 1974, which details are incorporated herein by reference to show the structure and general operation of the pressure fluid cylinder. Also contemplated within the scope of this invention relating to a drive means herein, is the device shown in Swedish patent specification No. 326,376.

Attached to the projection is a bracket 7 which in turn is attached directly to the dropping dead weight 3. As the piston moves, the projection 6 is moved and the bracket 7 is moved which in turn moves the dropping dead weight 3 in a vertical motion. In the case of the attachment of the projection 6 to the bracket 7 and the bracket 7 to the dropping dead weight 3, all such attachments are generally those which can be detached in the event it is necessary.

Attached to the dropping dead weight 3 are two cables 8 these cables 8 are attached to the dropping dead weight 3 by any suitable means 9, and the cables preferably being attached to the top or upper part of the dropping dead weight 3. Each of the cables 8 lead from the dropping dead weight 3 to a first freely rotating, vertically mounted idler pulley 10, wherein each cables 8 leads over its respective pulley 10 to lead away from each other to a second freely rotating, horizontally mounted idler pulley 11; around the outside of the second pulley and forward to and over a third freely rotating, vertically mounted idler pulley 13 and down to and connecting with a front mounted moveable sash member 14, shown partially in phantom. The dropping dead weight 3 moves within retaining channels 15 for smooth movement of the weight 3.

When the pressure fluid cylinder is activated, the projection 6 moves up or down in the slot 16. Since it is attached to the dropping dead weight 3, any movement of the projection 6 and the bracket 7 with the dropping dead weight 3, is in concert. As the dropping dead weight 3 is driven, the cables 8 are activated in concert therewith and the moveable sash member 14 is moved in the opposite direction. Thus, as the dropping dead weight 3 moves up, the sash member 14 moves down and vice versa.

Turning to FIG. 2, there is shown therein another embodiment of the invention wherein pressure fluid cylinder attachment is directly to the moveable sash member. For purposes of clarity, the exhaust duct hole and the standard lighting fixture have not been shown.

Thus, referring to FIG. 2 wherein like numbers have like meaning, therein is shown the top one half of a conventional fume hood structure 1 in a perspective view from the top front. A pressure fluid cylinder 4 is shown vertically mounted on the top front of the fume hood structure 1. The projection 6 of the cylinder is shown in partial phantom and by a cut-away of a small portion of the bracket 17. Such projection 6 is detachedly fixed to the bracket 17 by some suitable means 18 and the bracket 17 is in turn attached to the top of the sash member 14 by some suitable means 19. In FIG. 2, the front fume hood fascia 20 is partially cut-away in order to view the detaails of these attachments. Thus, when the pressure fluid cylinder 4 is activated, the projection 6 moves in a vertical motion which causes the bracket 17 and the moveable sash member 14 to move in concert therewith. Because the pressure fluid cylinder may be unstable in such a vertical position, it is preferred that it be stabilized by support members 21 attached securely to the fume hood structure.

Also illustrated in FIG. 2 is the auxiliary dropping dead weight system. It will be recalled from earlier discussion supra that this was an optional but preferred feature of the instant invention. With regard to this feature, there is shown in FIG. 2, in phantom, a side mounted dropping dead weight 22 to which is attached to two cables 23 and 24. The first of these cables, 23 leads from the dropping dead weight 22 to a first, freely rotatable, vertically mounted pulley 25, running up and over said first pulley to a second, freely rotatable, horizontally mounted pulley 26; running around said second pulley and forward to a third, freely rotatable, vertically mounted pulley 27, running up over said third pulley 27 and down to terminate and connect to the moveable sash member 14 at about point 30. In addition, cable 24 leads from the dropping dead weight 22 to the first pulley 25; thence to the second pulley 26; around the outside of pulley 26 and across the back of the fume hood structure 1 to the other side of the fume hood structure 1 to a fourth, freely rotatable horizontally mounted pulley 28; around the outside of pulley 28 and forward to a fifth, freely rotatable, vertically mounted pulley 29; running up and over pulley 29 and down to connect with the moveable sash member 14 at about point 31, and terminate there. Thus, when the pressure fluid cylinder 4 is activated and the moveable sash member moves, its weight is counter-balanced to a degree by the dropping dead weight 22 which provides for a smooth operation of the moveable sash member 14.

Figure 3:
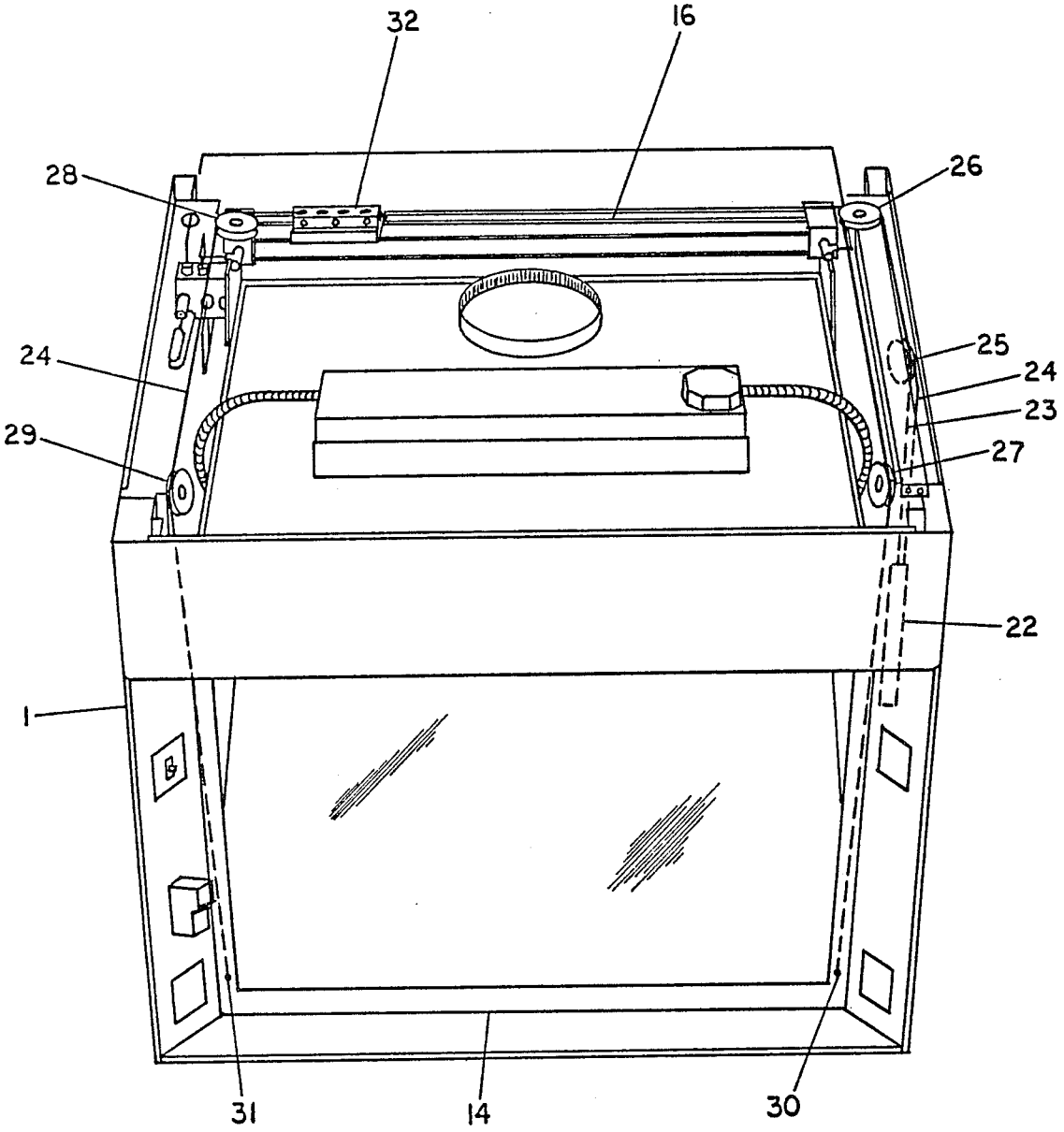
FIG. 3 is a perspective view of the top one half of a fume hood structure showing a conventional hood top and a fume hood front showing a moveable sash member in the down positions and the attachment of the pressure fluid cylinder directly to a drive cable for the moveable sash member.

Turning now to FIG. 3 and the most preferred embodiment of this invention, there is shown a perspective view of the top half of a conventional fume hood 1 showing the back, horizontal top placement of the pressure fluid cylinder and the cable connected thereto as a drive means. Referring to FIG. 3, there is shown the fume hood structure 1 and a perspective of the top and front thereof. Also shown is the moveable sash member 14, in place. Again, a side mounted dropping dead weight is shown as 22. Connected to the dropping dead weight 22, at or near the top thereof, are two cables 23 and 24. The first of the cables 23 leads from the dropping dead weight 22 to a first pulley 25; running up and over pulley 25 to a second pulley 26; running around said second 26 pulley and forward to a third pulley 27; running up and over said third pulley 27 and down to terminate and connect to the moveable sash member 14 at about the point 30. In addition, cable 24 leads from the dropping dead weight 22 to the first pulley 25; thence to the second pulley 26 and across the top back of the fume hood structure 1 to encounter the clamping means 32 in association with the projection 6 (not shown) wherein the cable 24 passes between the projection 6 and the clamping means 32 and is clamped and held firmly thereby; the cable 24 continuing on to a fourth pulley 28; around the outside of the pulley 28 and forward to a fifth pulley 29; running up and over pulley 29 and down to connect with the moveable sash member 14 at about point 31.

Thus, when the pressure fluid cylinder 4 is activated and the driving means, while clamping the cable 24, is moved, the moveable sash member 14 moves. Thus, in this embodiment, cable 24 drives the moveable sash member while cable 23 supplies the auxiliary dropping dead weight assistance for smooth operation of the moveable sash member.

It is contemplated within the scope of this embodiment that the pressure fluid cylinder can be positioned horizontally on the top, along the side of the fume hood structure. Placement in this manner causes the overall operation of the moveable sash member to have a shorter vertical movement as the full use of the pressure fluid cylinder cannot be realized owing to the lack of distance for adequate cable movement. In the event that a long movement is not required, or if one wishes to include additional pulley and cable network to increase the travel distance of the cable, there is no reason why the pressure fluid cylinder could not be mounted horizontally on the side of the fume hood structure.

Figure 4:
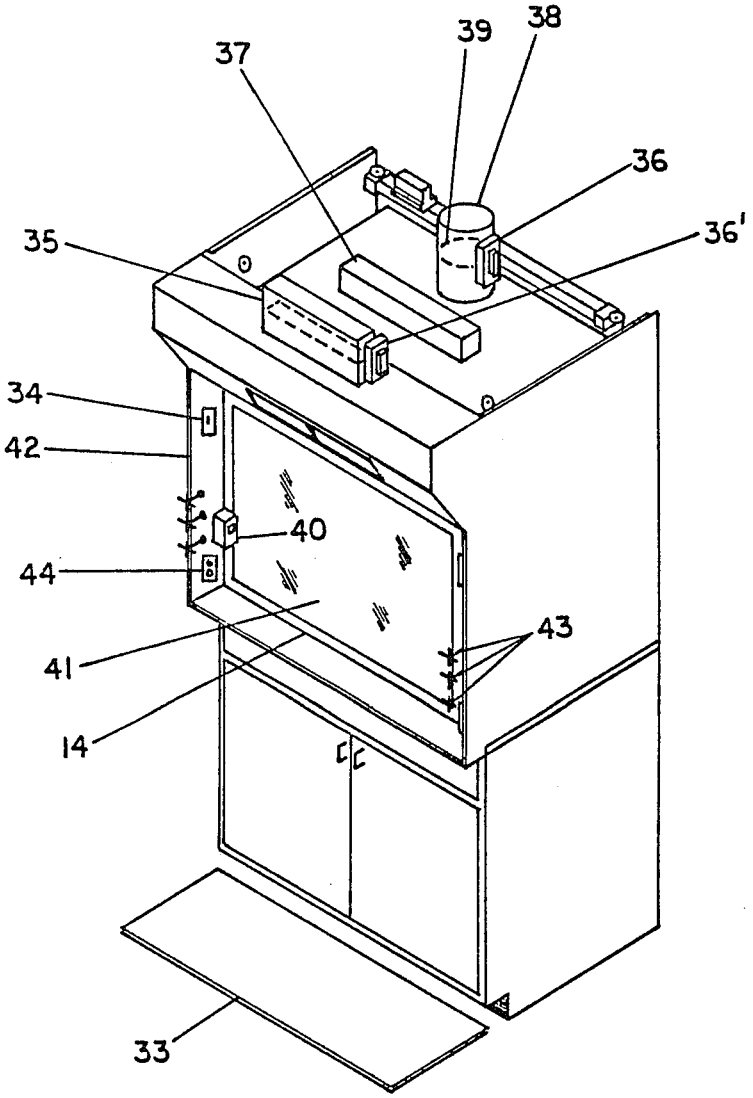
FIG. 4 is a view in perspective of an entire fume hood structure showing the auxiliary equipment useful therein.

In addition, the hood structure is illustrated in FIG. 4 as showing a floor mat 33 with a switch 34, an air induction duct 35, two, two-position motorized damper assembles 36 and 36' and, a fluorescent light fixture 37, an exhaust duct 38 containing a damper 39 shown in phantom, and a photo cell 40, all of which will be described in detail infra. Also, there is provided in the access opening a vertically movable sash member 14, shown as a transparent window framed by a metal casing. The side and bottom portions of the hood structure adjacent the access opening 41 are provided with respective fascia panels 42, the side panels of which may be provided with controls 43 and other accessory means such as switches 34, electrical outlets 44, and control light panels (not shown) for the control of the equipment of the fume hood.

In the operation of sash member it is desired to have the ability to instantly stop or start the movement of the sash member without interruption of or strain on, the power source. It is also desirable that once the movement of the sash member has been interrupted, it can automatically resume such movement to either finish opening or finish closing the sash member. In this manner, the sash member can be automatically opened or closed; it can be interrupted when it is moving into the open or closed position without damage to the element which obstructed the movement of the sash member and, once interrupted, the sash member can pause, then continue and finish cycle of its intended movement. For example, in a chemistry laboratory wherein this invention was being used, and the hood of this invention was adapted to a rubber floor mat switch, or perhaps operated by a photo electric eye and associated means, the sash would automatically close when the operating personnel moved away from the hood front. In the prior art hood system such as that found in U.S. Pat. No. 4,150,606, if a glass beaker, for example, were carelessly left in the path of travel of the sash member when it was closing, the sash member would contact the glass beaker and the sash would stop. The motor would continue to rotate the drive pulley which would result in a burned out motor or an abraded cable, whichever occurred first owing to the fact that the cable would never drive the limit switch activator to its destination at the limit switch.

In the instant invention, however, given the same set of circumstances as above, when the sash member strikes the glass beaker, the sash member immediately stops, lightly rests against the object for a pre-set period of time (perhaps 1–2 seconds) and then the drive means for the sash member is automatically stopped and the sash member remains in the stop position. It will not open and provide an energy loss, nor will the sash oscillate in the access opening. The sash will remain in the obstructed open position until the operating personnel removes the object and reactivates the drive means for the sash member, at which point the system will automatically recycle the sash member to a fully closed or fully opened position, depending on the presence or absence of operating personnel.

The invention herein is also designed so that there may be incorporated means for controlling the operation of exhaust blowers, for example, multiple speed blowers, or auxiliary air blowers.

As shown in U.S. Pat. No. 4,502,375, issued Mar. 5, 1985, the sash member may be controlled in response to the presence or absence of operating personnel by any one of my types of switch mechanisms, for example, rubber or plastic floor mat switches, photo electric eyes or manual switches. Also, to prevent undesired operation of any kind, a suitable time delay device may be included to prevent activation of the sash.

The electrical circuits include relay means for operating exhaust blowers and auxiliary air make-up blowers, whereby, in addition to controlling the opening, closing, stopping and starting of the sash member, the high-low speed of the blowers may also be controlled so that they will be operated at high speed when the sash member is in a raised position and operated at a lower speed when the sash member is in a lowered or closed position, If an auxiliary air blower is also provided, it may be suitably connected to operate, for example, only when the exhaust blower is operating at high speed or it can be complimentary or supplemental, as needed.

While the use of auxiliary air will reduce the quantity of conditioned room air withdrawn during operation of the fume hood, the auxiliary air is normally supplied at around 60° F. and may require heating the air to such temperatures. Therefore, if the auxiliary air is not necessary, it can be discontinued and the energy savings alluded to supra can be realized. This short discussion of auxiliary air blowers covers the state of the art in fume hoods and a detailed discussion of the manual override for the air handling system will not be covered in detail herein. Such information can be found in U.S. Pat. Nos. 4,150,606, issued Apr. 24, 1979, and 4,502,375, issued Mar. 5, 1985, which patents are hereby incorporated by reference.

We claim:

1. A trimodal piston driven sash operator for a fume hood structure, said fume hood structure having an access opening in one wall thereof and a closure structure therefor, including a moveable sash member disposed for movement in said access opening to vary the effective size of the opening thereof, comprising:

a power source;

a drive means driven by the power source; said drive means mounted on a stationary portion of the fume hood structure, which drive means is a pressure fluid cylinder having a slot extending longitudinally along its wall thereof, and a piston provided with a projection extending through said slot and slidable along said slot in concert with said piston when the drive means is activated from the power source;

a drive bracket being attached to said drive means by suitable means and said drive bracket detachedly fixed to a weighted structure within the hood;

a means of controlling the power source to control the movement of the weighted structure, to control movement of the moveable sash member in said access opening.

2. A trimodal piston driven sash operator for a fume hood structure, said fume hood structure having an access opening in one wall thereof and a closure structure therefor, including a movable sash member disposed for movement in said access opening thereof, comprising:

a power source;

a drive means powered by said power source; said drive means mounted on a stationary portion of the fume hood structure, which drive means is a pressure fluid cylinder having a slot extending longitudinally along its wall thereof, and a piston provided with a projection extending through said slot and slidable along said slot in concert with said piston when the drive means is activated from the power source;

a clamping means detachedly fixed to said projection;

a drive cable, said drive cable being detachedly fixed to the moveable sash member and extending from the moveable sash member to a freely rotatable first hood idler pulley which is vertically mounted on said fume hood structure; said drive cable continuing over the first hood idler pulley, extending to and around the outside of a freely rotatable, second hood idler pulley which is horizontally mounted on said fume hood structure; said drive cable passing to said drive means and being detachedly fixed thereto; said drive cable extending from said drive means to a freely rotatable, third hood idler pulley horizontally mounted on said hood structure, said drive cable passing around the outside of the third hood idler pulley and over a freely rotatable, vertically mounted fourth hood idler pulley mounted within the hood structure, the drive cable terminating and connecting to a freely moving weighted structure within the fume hood structure;

a means of controlling the drive means to control the movement of the drive cable to control the movement of said sash in said access opening.

3. A trimodal piston driven sash operator for a fume hood structure, said fume hood structure having an access opening in one wall thereof and a closure structure therefor, including a moveable sash member disposed for movement in said access opening to vary the effective size of the opening thereof, comprising:

a power source;

a drive means driven by the power source; said drive means mounted on a stationary portion of the fume hood structure, which drive means is a pressure fluid cylinder having a slot extending longitudinally along its wall thereof, and a piston provided with a projection extending through said slot and slidable along said slot in concert with said piston when the drive means is activated from the power source;

a drive bracket being attached to said drive means by suitable means and said drive bracket detachedly fixed to the top of the moveable sash member;

a means of controlling the power source to control the movement of the drive means, to control the movement of the sash in said access opening.

4. A fume hood having a trimodal piston driven sash operator, said fume hood having an access opening in one wall thereof and a closure structure therefor, including a moveable sash member disposed for movement in said access opening to vary the effective size of the opening thereof, comprising:

a power source;

a drive means driven by the power source; said drive means mounted on a stationary portion of the fume hood structure, which drive means is a pressure fluid cylinder having a slot extending longitudinally along its wall thereof, and a piston provided with a projection extending through said slot and slidable along said slot in concert with said piston when the drive means is activated from the power source;

a drive bracket being attached to said drive means by suitable means and said drive bracket detachedly fixed to a weighted structure within the hood; a means of controlling the power source to control the movement of the weighted structure, to control the movement of the moveable sash member in said access opening.

5. A fume hood having a trimodal piston driven sash operator, said fume hood having an access opening in one wall thereof and a closure structure therefor, including a moveable sash member, disposed for movement in said access opening thereof, comprising:

a power source;

a drive means powered by said power source; said drive means mounted on a stationary portion of the fume hood structure, which drive means is a pressure fluid cylinder having a slot extending longitudinally along its wall thereof, and a piston provided with a projection extending through said slot and slidable along said slot in concert with said piston when the drive means is activated from the power source;

a clamping means detachedly fixed to said projection;

a drive cable, said drive cable being detachedly fixed to the moveable sash member and extending from the moveable sash member to a freely rotatable first hood idler pulley which is vertically mounted on said fume hood structure; said drive cable continuing over the first hood idler pulley, extending to and around the outside of a freely rotatable, second hood idler pulley which is horizontally mounted on said fume hood structure; said drive cable passing to said drive means and being detachedly fixed thereto; said drive cable extending from said drive means to a freely rotatable, third hood idler pulley horizontally mounted on said hood structure, said drive cable passing around the outside of the third hood idler pulley and over a freely rotatable, vertically mounted fourth hood idler pulley mounted within the hood structure, the drive cable terminating and connecting to a freely moving weighted structure within the fume hood structure;

a means of controlling the drive means to control the movement of the drive cable to control the movement of said sash in said access opening.

6. A fume hood having a trimodal piston driven sash operator, said fume hood having an access opening in one wall thereof and a closure structure therefor, including a moveable sash member disposed for movement in said access opening to vary the effective size of the opening thereof, comprising:

a power source;

a drive means driven by the power source; said drive means mounted on a stationary portion of the fume hood structure, which drive means is a pressure fluid cylinder having a slot extending longitudinally along its wall thereof, and a piston provided with a projection extending through said slot and slidable along said slot in concert with said piston when the drive means is activated from the power source;

a drive bracket being attached to said drive means by suitable means and said drive bracket detachedly fixed to the top of the moveable said member;

a means of controlling the power source to control the movement of the drive means, to control the movement of the sash in said access opening.

* * * * *